US009587396B1

(12) United States Patent
Staschiak et al.

(10) Patent No.: US 9,587,396 B1
(45) Date of Patent: Mar. 7, 2017

(54) DECORATIVE STRUCTURES WITH REMOVABLE DISPLAY RETAINERS, AND USE THEREOF

(71) Applicants: Anthony Staschiak, Columbus, OH (US); Chelsey Crago-Lowry, Columbus, OH (US)

(72) Inventors: Anthony Staschiak, Columbus, OH (US); Chelsey Crago-Lowry, Columbus, OH (US)

( * ) Notice: Subject to any disclaimer, the term of this patent is extended or adjusted under 35 U.S.C. 154(b) by 0 days.

(21) Appl. No.: 14/852,075

(22) Filed: Sep. 11, 2015

(51) Int. Cl.
*E04B 1/34* (2006.01)
*E04B 1/38* (2006.01)
*E04F 10/08* (2006.01)

(52) U.S. Cl.
CPC ..... *E04B 1/38* (2013.01); *E04F 10/08* (2013.01)

(58) Field of Classification Search
CPC .... E04F 10/08; B44C 5/04; E04B 2001/2412; E04C 3/30; E06B 1/34; G09F 7/18
USPC ..... 52/36.4, 36.5
See application file for complete search history.

(56) References Cited

U.S. PATENT DOCUMENTS 5,622,504 A * 4/1997 Hance ..... G09B 29/001 434/421
6,272,801 B1 * 8/2001 Suh ..... E06B 3/5892 49/505
D469,547 S * 1/2003 Panek ..... D25/100
2006/0150544 A1 * 7/2006 Foster ..... B44C 5/04 52/204.1
2013/0095273 A1 * 4/2013 Rinaudo ..... G09F 7/18 428/43

* cited by examiner

*Primary Examiner* — Rodney Mintz
*Assistant Examiner* — Daniel Kenny
(74) *Attorney, Agent, or Firm* — Standley Law Group LLP

(57) ABSTRACT

Decorative structures for use at ceremonies or other events, the decorative structures having one or more removable and transportable display retainers for retaining a display of flowers and/or other items. In some embodiments, the removable display retainer may be particularly adapted for a dissimilar decorative use at a different location where a subsequent portion of a given ceremony or other event will take place.

20 Claims, 7 Drawing Sheets

DECORATIVE STRUCTURES WITH REMOVABLE DISPLAY RETAINERS, AND USE THEREOF

TECHNICAL FIELD

Exemplary embodiments described herein are directed to decorative structures for use at ceremonies or other events, and particularly to such structures having a removable display retainer for retaining a display of flowers and/or other items.

BACKGROUND

As would be familiar to many persons, and certainly to those of skill in the art, decorative structures are commonly used at a variety of different events. Such structures may include for example, and without limitation, arches, arbors, gazebos, and pillars. These structures may serve as backdrops during ceremonies (e.g. weddings) or other activities such as photo sessions, may function as entryways or other pass-throughs via which persons may walk, etc.

Frequently, such structures are adorned with flowers and/or other decorations when used for ceremonies or other events. Because the associated structures are not transportable, or at least not easily transportable, any added decorations typically remain with the structure until later removed. As a result, such decorations are not generally moved to and used at another location in the case where portions of a ceremony or other event take place both at the location of the structure and at a subsequent location.

The inability to transfer and reuse such decorations at a latter portion of a ceremony or other event is problematic, at least because such decorations are frequently costly and, in the case of existing structures, may be very time consuming and possibly ergonomically difficult to attach. Additionally, because like or similar decorations may also be desirable at the location of a subsequent portion of a given ceremony or event, it is commonly necessary to purchase and install a second set of such decorations at the subsequent location. But for the aforementioned problems of transferring the decorations adorning a previously used structure to the subsequent ceremony or event location, it can be easily understood that a great deal of time and expense might be saved.

It is clearly evident that the difficulties associated with transferring decorations commonly applied to exemplary structures is problematic. Exemplary decorative structure embodiments described herein are directed at eliminating this problem.

SUMMARY

Exemplary embodiments described herein are directed to decorative structures for use at ceremonies or other events, and particularly to such structures having a removable and transportable component(s) for retaining a display of flowers and/or other items. Such structures may include for example, and without limitation, arches, arbors, pergolas, gazebos, and pillars. Other comparable structures may also certainly exist, or may come into existence, and all such structures used for similar purposes are considered to be within the scope of the present disclosure.

As mentioned above, structures of interest may serve as backdrops during ceremonies or other activities such as photo sessions, and/or may function as entryways or other pass-throughs via which persons may walk, etc. However, structures of interest may also serve other purposes, and all uses of such structures of interest are considered to be within the scope of the present disclosure.

Furthermore, while various exemplary embodiments of structures are described herein as being decorative in nature, it should be realized that such structures may also have a structural function. For example, a structure of interest may serve as a support for another structure, may act as a shelter, etc. Thus, any structure to which a decorative display may be attached is considered to fall within the scope of a decorative structure as said terminology is used herein.

Generally speaking, unlike known decorative structures, an exemplary decorative structure according to the disclosure includes one or more easily removable display retainers for retaining a display of flowers and/or other items. The inclusion and use of one or more such removable display retainers provides several benefits not afforded by known structures. For example, a removable display retainer may be removed from the structure for the attachment of decorations such as flowers and/or other items. This simplifies installation of said decorations because the attachment process may be conducted at ground level and on a support assembly, such as a table. With the removable display retainer detached from the associated structure, the removable display retainer may also be manipulated (rotated, etc.) to facilitate attachment of the decorations, and decoration of the removable display retainer may also be conducted at a location remote from the structure (e.g., at a florist shop). In contrast, the attachment of like decorations to a known decorative structure normally requires the use of a ladder or similar device, multiple ascents and descents of the ladder, and attachment of the decorations to the structure at an elevated and fixed location and orientation.

As should be obvious, the inclusion and use of one or more such removable display retainers also facilitates detachment of decorations such as flowers and/or other items from the structure upon completion of the event, ceremony, etc., for which the structure was decorated. Particularly, the decorated removable display retainer may again be detached from the structure and transferred to a support assembly, the ground, etc., whereby removal of the decorations is facilitated and is more ergonomically friendly. As with the attachment process, the detached removable display retainer may also be manipulated (rotated, etc.) to facilitate detachment of the decorations. In contrast, the detachment of like decorations from a known structure would once again normally require the use of a ladder or similar device, multiple ascents and descents of the ladder, and detachment of the decorations from the structure at an elevated and fixed location and orientation.

Another benefit afforded by a decorative structure having one or more such removable display retainers relates to additional use and enjoyment of the decorations at another location—which may be a location in the immediate or general vicinity of the structure, or a location remote from the structure (e.g., another site or venue). More specifically, because the decorated display retainer may be easily detached from the decorative structure, it may be transported in the decorated state to another location for additional use, such as for example, a location where a subsequent portion of a ceremony or other event will take place. In one non-limiting example, the structure may be a bridal arch or a pergola having a decorated removable display retainer that initially adorns the structure during a marriage ceremony and is afterwards removed and transported to the location of a subsequent wedding reception for placement on the table of the bride and groom, or elsewhere. The ability to use a decorated display retainer at a location other than the decorative structure to which it is attached not only allows for extended enjoyment of the decorations attached to the removable display retainer, but may also eliminate or at least reduce the need to provide additional decorations at the subsequent event site or venue to which the decorated display retainer is transferred.

The precise nature of a removable decorated display retainer according to the disclosure may vary depending on the particular type of decorative structure with which said component is associated. For example, when the decorative structure is a pergola or arch, the removable display component may be a (safely-removable) rail (rafter) or cross-member (slat or purlin) of the decorative structure, or may be a separate component (board, rail, tube) that is removably attached to such a rail, cross-member or other structure element. When the decorative structure is a gazebo, for example, the removable display component may be a top plate trim board, or may be a separate component that is removably attached to such a top plate or trim board, to a fence rail, or to a pair of support posts or the ends of a pair of ridge rails. Other attachment points are also possible in either example.

Removable attachment of a removable display retainer may be accomplished in various ways, and may depend, at least in part, on the composition, size, weight and/or configuration, of the given removable display retainer. For example, and without limitation, a given removable display retainer may be removably attached to an associated decorative structure by way of engageable hooks and eye screws/bolts; support components such as sawtooth hangers, wire, or D-rings in combination with appropriate male components such as threaded fasteners or nails; a pin and keyhole arrangement; a pin and grommet arrangement; an interlocking wedge or cleat assembly; a hook and loop fastener(s) assembly (e.g., Velcro®); double-sided tape; and/or any other suitable releasable retention mechanism or assembly that would be or should be familiar to one of skill in the art, as long as the selected retention mechanism or assembly facilitates attachment/detachment and can adequately and safely retain the removable display retainer until it is deliberately detached.

Other aspects and features of the invention will become apparent to those skilled in the art upon review of the following detailed description of exemplary embodiments along with the accompanying drawing figures.

BRIEF DESCRIPTION OF THE DRAWINGS

In the following descriptions of the drawings and exemplary embodiments, like reference numerals across the several views refer to identical or equivalent features, and.

DETAILED DESCRIPTION OF THE EXEMPLARY EMBODIMENTS

As explained above, exemplary embodiments according to the disclosure are directed to decorative structures, typically for use at ceremonies or other events, and particularly to such structures having a removable, and possibly transportable, display retainer(s) for retaining a display of flowers and/or other items. Such structures may include for example, and without limitation, arches, arbors, pergolas, gazebos, and pillars. Other comparable structures may also certainly exist, or may come into existence, and all such structures used for similar purposes are considered to be within the scope of the present disclosure.

Figure 1:
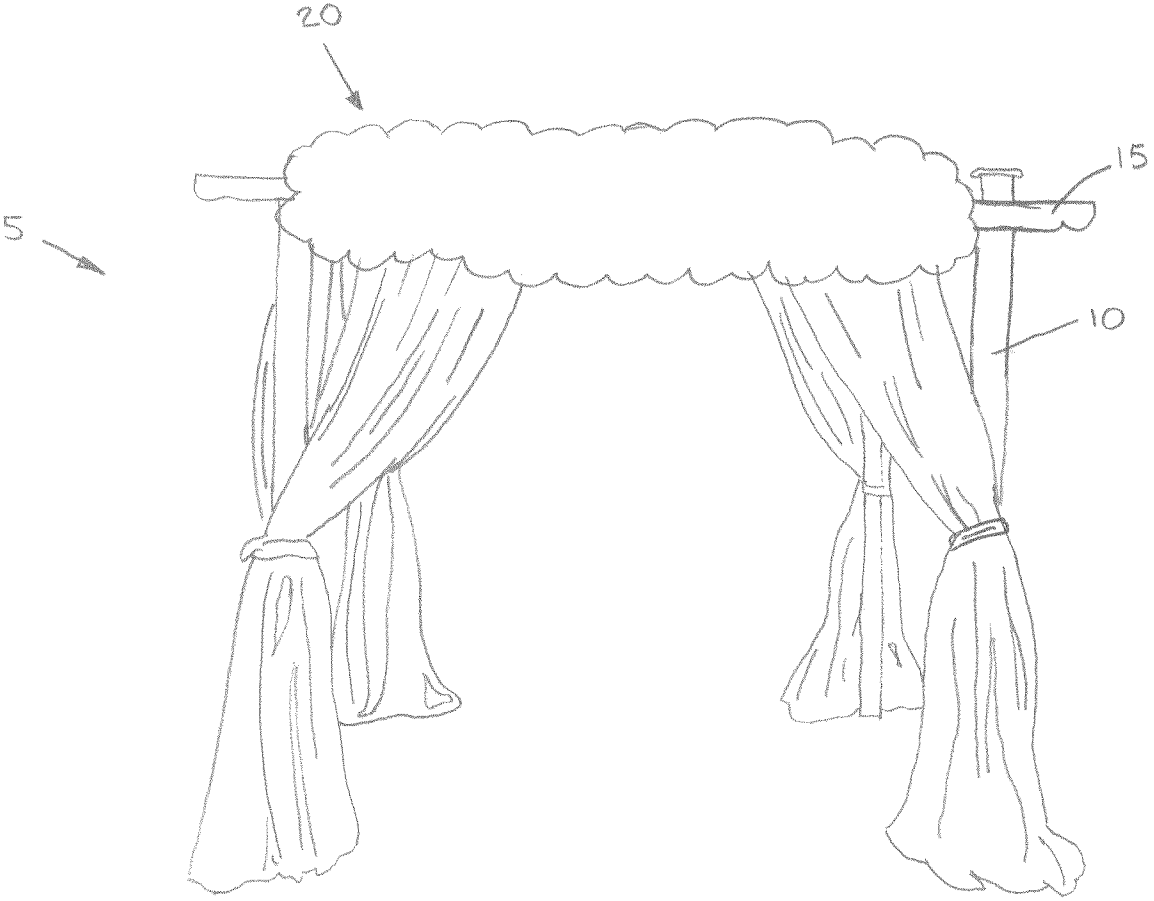
FIG. 1 is an elevation view of an exemplary decorative pergola structure subsequent to being decorated for an event or ceremony.

One typical decorative structure 5 is provided in FIG. 1 for the purpose of generally conveying how such a structure may be decorated for a particular ceremony or other event. In this particular example, the decorative structure 5 is in the form of a known pergola or arbor, which includes a framework comprising a number of vertical support posts 10 connected near a top end thereof to a plurality of rafters 15. Commonly, such a structure also includes a multitude of cross-members that traverse and are connected to the rafters. While the exemplary structure of FIG. 1 is a pergola/arbor, it should be understandable and obvious that other structures of interest could be similarly decorated.

Referring still to FIG. 1, the element of particular interest with respect to the present disclosure is the flower display 20 that extends across the front-facing side of the structure 5, along the elevated top edge thereof. As can be observed, this exemplary flower display 20 is comprised of numerous flowers, greenery, etc. Traditionally, each of these flowers and other display elements have been required to be attached to such an assembled structure 5 by using a ladder or similar device to hand-carry each of the flowers and other display elements up to the height of the desired display attachment point, whereafter each display element may be attached to some existing component (e.g., a rafter) of the decorative structure 5 in whatever location and orientation that the component resides. This process is repeated until all of the display elements are attached to the decorative structure 5, and then subsequently recurs in reverse order at the time of removing the flower display 20.

As described above, this aforesaid existing process for attaching and detaching displays (such as the exemplary flower display 20) from such decorative structures is time consuming, may be ergonomically undesirable, and generally does not permit the display to be removed and subsequently transported to another location for further use at an ensuing portion of a given ceremony or other event.

Exemplary embodiments described herein are designed to facilitate attachment and detachment of displays from decorative structures and, consequently, to enable their further use in various subsequent portions of a given ceremony or other event—even if the further use occurs at another location and transport of the display is required. To this end, one exemplary decorative structure 50 according to the disclosure is depicted in part in FIG. 2. For purposes of illustration only, the decorative structure 50 is again in the form of a pergola or arbor, but the unique features thereof are equally applicable to other decorative structures. The decorative structure 50 includes a framework comprising a number of vertical support posts 55, which are interconnected by a plurality of beams 60 and rafters 65. Again, such a structure may also include a multitude of cross-members (not shown) that traverse and are connected to the rafters 65 or the beam 60*s*.

Figure 2:
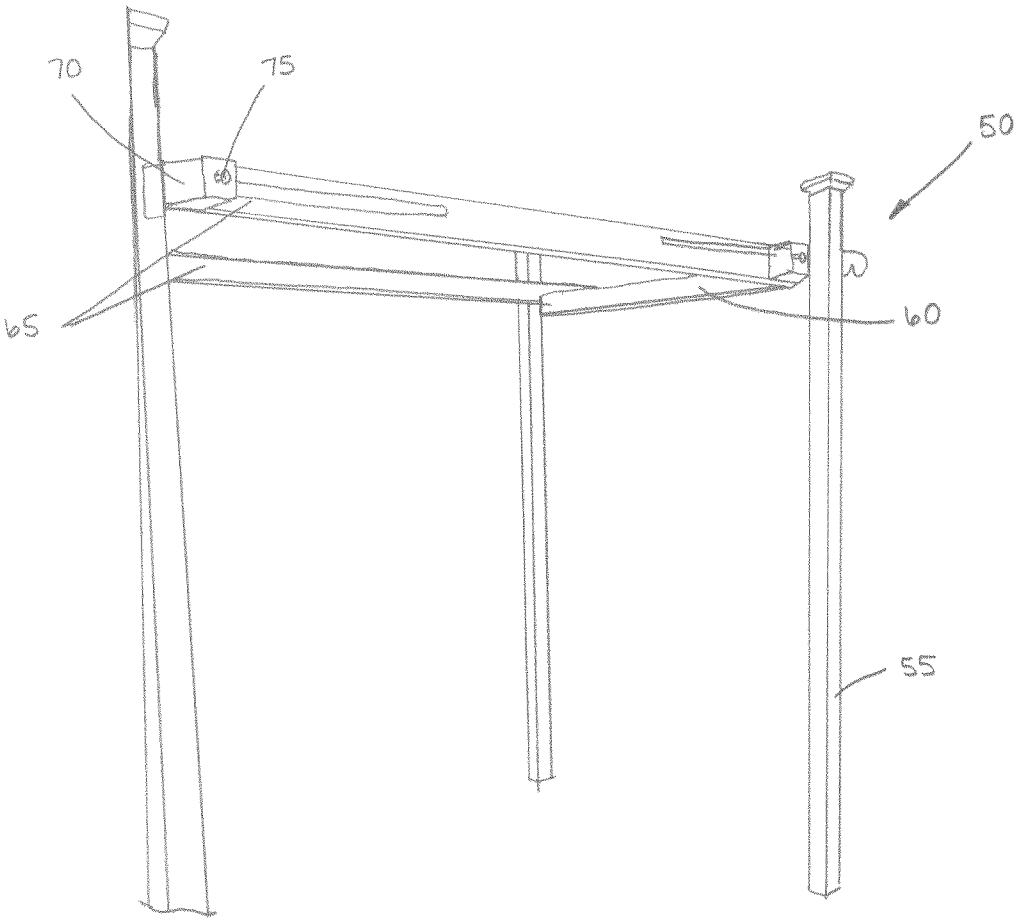
FIG. 2 shows a portion of an exemplary decorative pergola structure according to the disclosure, wherein the pergola structure has been adapted for the attachment/detachment of a removable display retainer.

Unlike known decorative structures, the inventive decorative structure 50 of FIG. 2 is equipped with a removable display retainer retention assembly having a pair of removable display retainer engagement features. In this particular exemplary embodiment, the removable display retainer retention assembly is comprised of a pair of mounting blocks 70 and associated retention pins 75 (e.g., bolts), the pins acting as the removable display retainer engagement features. In this example, mounting blocks 70 are provided on the forwardmost rafter 65 to position the removable display retainer (see below) along approximately the same plane, or forward of the same plane, as the front face of the support posts 55 when the removable display retainer is attached to the decorative structure 50. This is an optional feature. For example, the mounting blocks 70 could be omitted and the retention pins 75 could be installed directly to the rafter 65 in other embodiments. In any event, as described in more detail below, the removable display retainer retention assembly engages a removable display retainer in a manner that facilitates the attachment and detachment of the removable display retainer to/from the decorative structure 50. It should also be noted that while only one display retainer retention assembly is shown in FIG. 2, the decorative structure 50 could also include a display retainer retention assembly on one or more other sides thereof, as well as more than one display retainer retention assembly on a given side.

Figure 3:
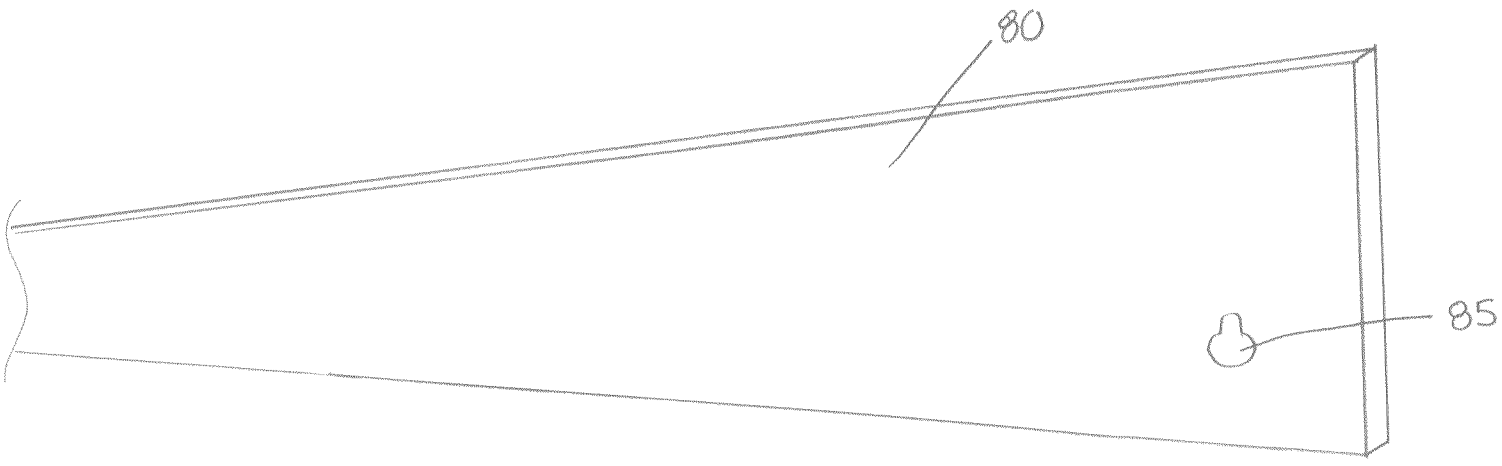
FIG. 3 is an enlarged, partial view of an exemplary removable display retainer.

One exemplary removable display retainer 80 designed to removably engage the display retainer retention assembly of FIG. 2 is partially depicted in FIG. 3. In this particular example, the removable display retainer 80 is comprised of an elongate board in the form of a beam, plank, etc., having a composition and appearance that is similar to the other main components 55, 60, 65 of the decorative structure 50. This is not a requirement, however, and indeed may not be the case in alternative embodiments.

A display retainer retention assembly engagement feature 85 is visible near the lower right-hand corner of the removable display retainer 80 in FIG. 3. Such a feature is also present near the lower left-hand corner of the removable display retainer 80, but is not visible in FIG. 3 due to the length of the removable display retainer. In this particular embodiment, each removable display retainer retention assembly engagement feature 85 is provided as a keyhole slot that is adapted to receive and releasably engage a corresponding one of the retention pins 75 located on the removable display retainer retention assembly of the decorative structure 50, in a manner that would be easily understood by one of skill in the art.

The display retainer retention assembly engagement feature(s) provided in/on other exemplary removable display retainer embodiments may be in a form other than a keyhole slot, as may be dictated by the corresponding engagement element(s) installed on the decorative structure. For example, alternative retention elements provided to removably couple a removable display retainer to a decorative structure in other embodiments may include, without limitation, engageable hooks and eye screws/bolts; female components such as sawtooth hangers, wire, or D-rings in combination with appropriate male components such as threaded fasteners, nails or hooks; a pin and grommet arrangement; an interlocking wedge or cleat assembly; a hook and loop fastener(s) assembly (e.g., Velcro®); double-sided tape; and/or any other suitable mechanism or assembly that would be or should be familiar to one of skill in the art, as long as the selected retention mechanism or assembly facilitates attachment/detachment and can adequately and safely retain the removable display retainer and any decorative elements attached thereto on the decorative structure until the removable display retainer is deliberately detached.

Figure 4:
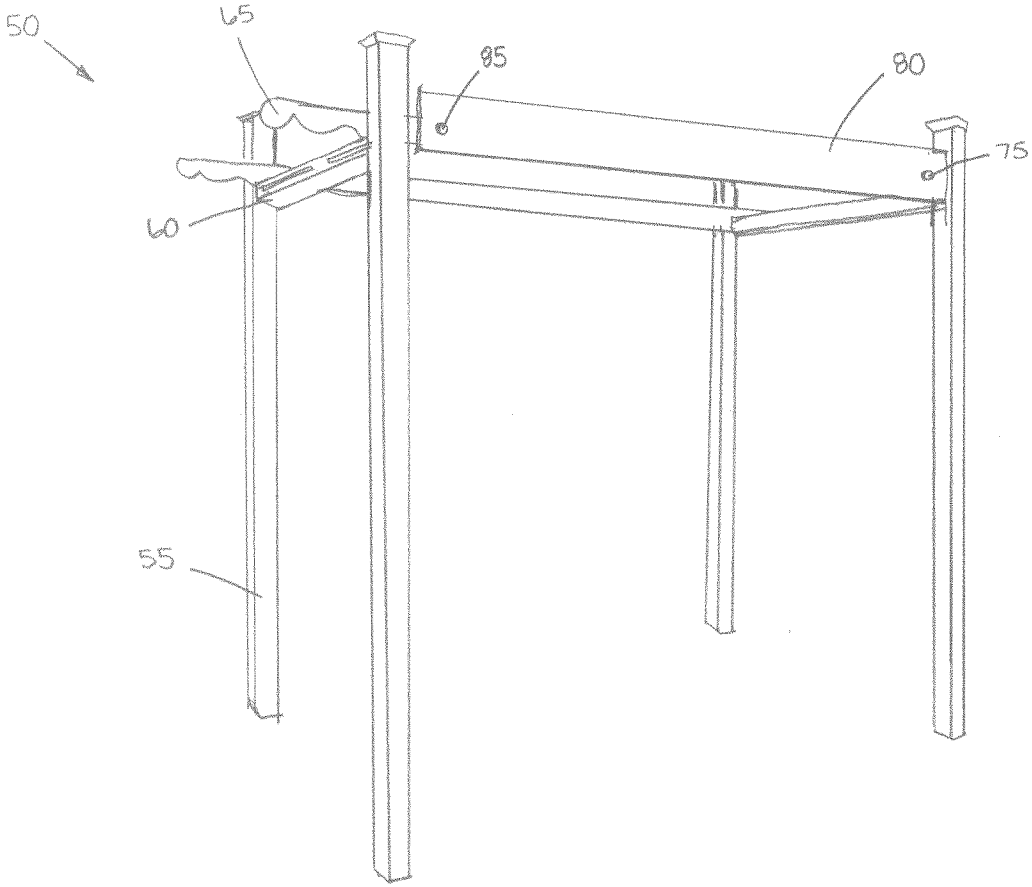
FIG. 4 shows the removable display retainer of FIG. 3 removably attached to the decorative pergola structure of FIG. 3.
Figure 5:
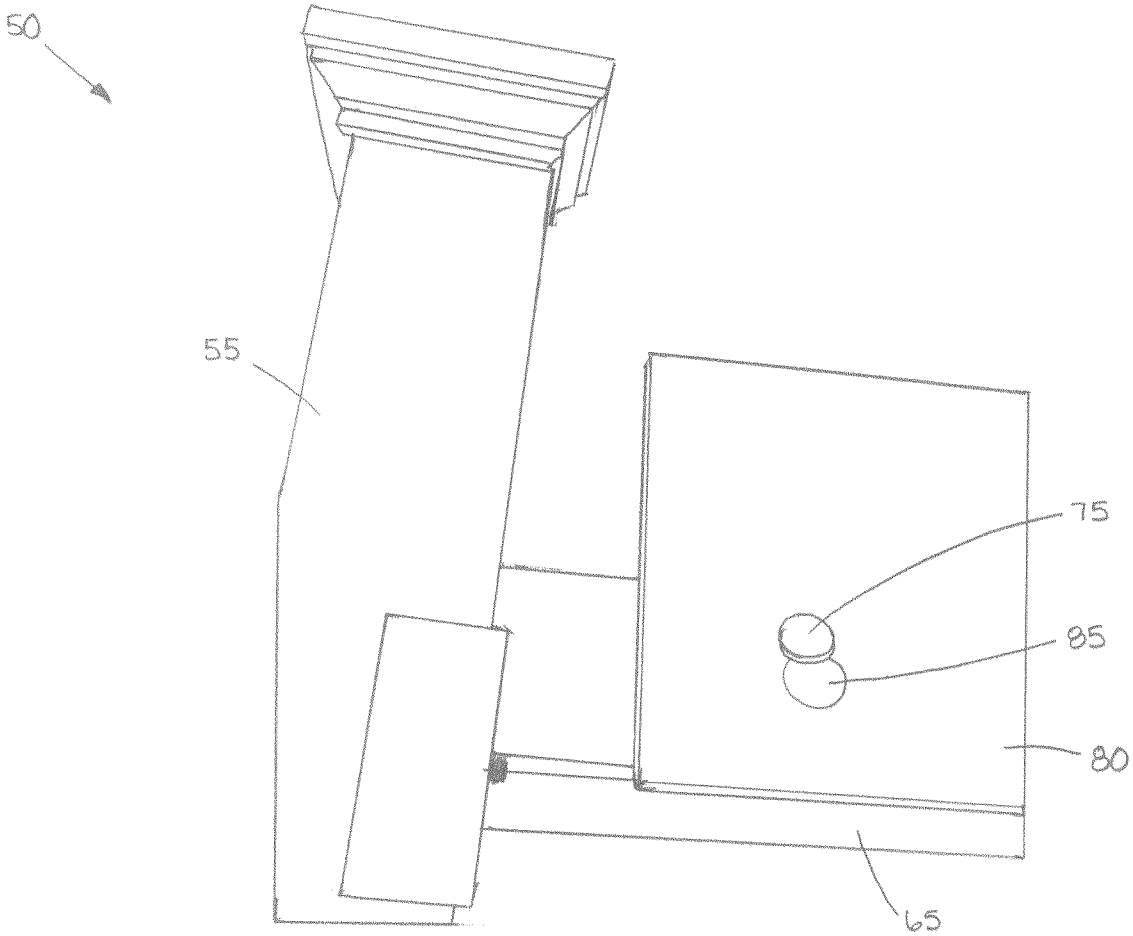
FIG. 5 is an enlarged, partial view of the attached removable display retainer of FIG. 4.

Removable attachment of the removable display retainer 80 to the decorative structure 50 via engagement of the retention pins 70 of the display retainer retention assembly with the keyhole slots 85 of the removable display retainer, is illustrated in FIG. 4 and the enlarged view of FIG. 5. The entirety of the removable display retainer 80 can be observed to be removably attached to the decorative structure 50 in FIG. 4, at a location wherein it is desirable to provide a decorative display of flowers or the like for a ceremony or other event. As mentioned above, other removable display retainers 80 could be similarly or otherwise removably attached to other sides of the decorative structure 50.

Engagement of the retention pin 75 of the display retainer retention assembly with the keyhole slot 85 of the removable display retainer 80 can be better observed in the enlarged view of FIG. 5. As described above, it can also be observed in FIG. 5 that in this exemplary embodiment the removable display retainer 80 is optionally maintained by the mounting blocks 70 (not visible) in a position that is substantially aligned with a forward face of the support posts 55.

When it is desired to decorate the decorative structure 50 by attaching one or more display elements along the area at which the removable display retainer 80 resides, the removable display retainer is simply disengaged from the display retainer retention assembly and removed from the decorative structure. As should be obvious, such is accomplished in the case of this exemplary decorative structure 50 by lifting up on the removable display retainer 80 until the retention pins 75 are aligned with the enlarged portion of the keyhole slots 85 in the removable display retainer, and then sliding the removable display retainer forward and off of the retention pins. The removable display retainer 80 may then be taken to any location where it is most desirable to attach the decorative elements thereto (e.g., to a florist shop).

Figure 6:
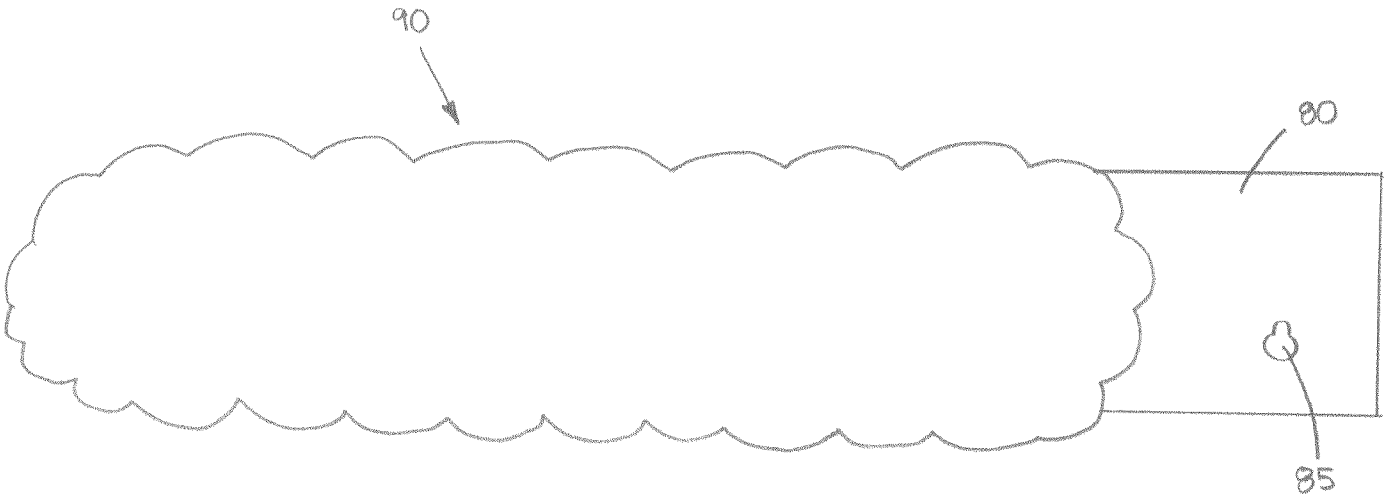
FIG. 6 depicts, in partial transparency, an exemplary removable display retainer detached from an associated decorative structure and decorated with a multitude of flowers.

As represented in the partially transparent view of FIG. 6, the removable display retainer 80 may be decorated with flowers and/or other items as desired while detached from the decorative structure. Once decorated, the decorated removable display retainer 80 may be returned to the decorative structure 50 and again removably attached thereto by lifting the removable display retainer into position and simply causing the keyhole slots 85 thereof to become re-engaged with the retention pins 75 of the display retainer retention assembly. The decorated removable display retainer 80 may subsequently be easily detached from the decorative structure 50 for purposes of removing the decorative elements therefrom. Similarly, because of the simplicity and ease with which the decorated removable display retainer 80 may be removed from the decorative structure, it can be easily understood that the decorated removable display retainer may also be timely removed and transported to another location for use in a subsequent portion of the associated ceremony or other event.

Figure 7:
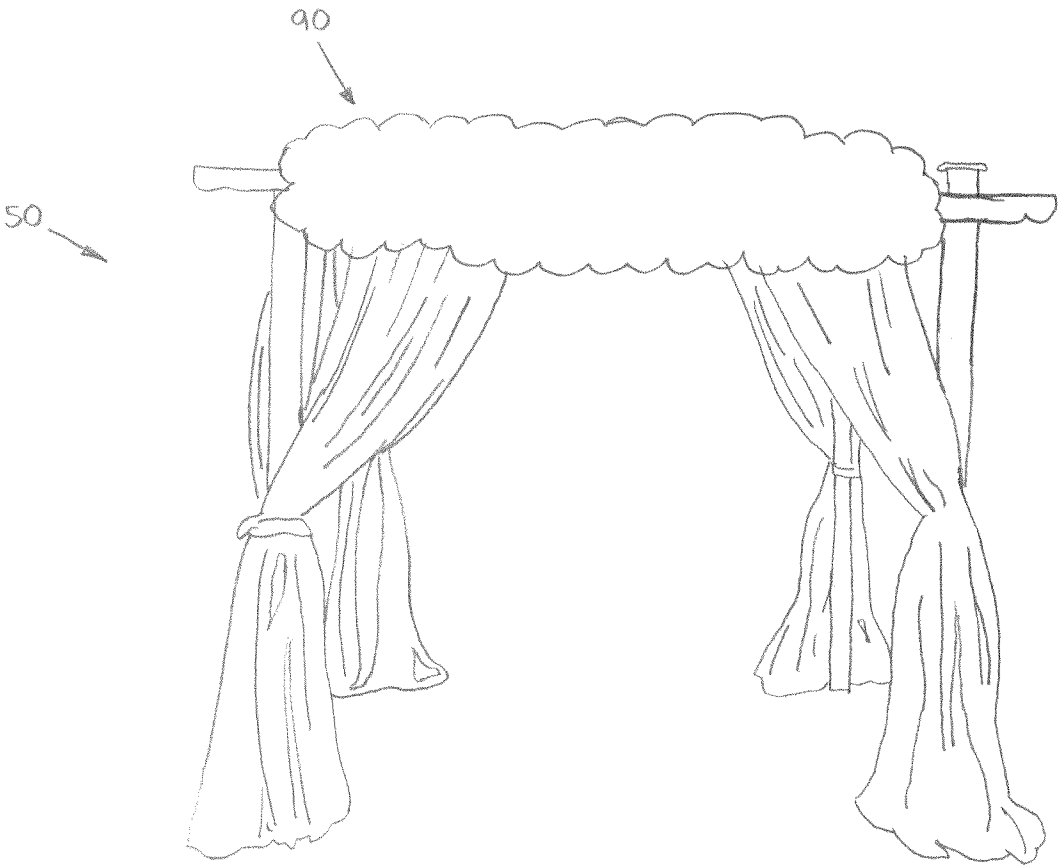
FIG. 7 is an elevation view of the exemplary decorative pergola structure of FIG. 4 subsequent to the removable decorative retainer thereof being decorated for an event or ceremony.

The fully-decorated removable display retainer 80 is depicted in a state of removable attachment to the decorative structure 50 in FIG. 7. It may be observed that the decorative structure 50 of FIG. 7 is substantially duplicative in appearance to the known decorative structure 5 of FIG. 1. The purpose of this duplicative representation is to clearly show that a decorative structure as described herein has at least as good an appearance as a known decorative structure that has been similarly decorated according to known decorating techniques. That is, the appearance of the known decorated decorative structure 5 of FIG. 1 and the similarly decorated decorative structure 50 of FIG. 7 is substantially identical, but the decorative structure of FIG. 7 offers all of the aforesaid benefits which are devoid from the decorative structure of FIG. 1.

A decorative structure and its removable display retainer (s) according to the disclosure may be comprised of a number of different materials including, but not limited to, wood, synthetic/composite wood, plastic, fiberglass, and metal. In some embodiments, the composition of the main components of the decorative structure and the composition of an associated removable display retainer(s) may be the same. In some embodiments, the composition of the main components of the decorative structure and the composition of an associated removable display retainer(s) may be dissimilar.

The size and shape of a given removable display retainer may also vary, depending largely on the decorative structure with which the removable display retainer is associated and the type of decorations that will adorn the removable display retainer.

Although the exemplary embodiment depicted in FIGS. 2-7 includes a floral display, it is to be understood that decorations of a type other than flowers may also be attached to a removable display retainer and removably attached to a decorative structure. Displays comprising a combination of flowers and other types of non-floral decorations are also possible. In still other embodiments, a removable display retainer may instead be engraved, embossed, painted, covered with photographs, wrapped in a graphic film, or otherwise decorated. Consequently, any type of adornment that may be associated with a removable display retainer is considered to be within the scope of the disclosure.

As mentioned above, at least certain embodiments of a removable display retainer are adapted to be removed from an associated decorative structure and transported to another location for further use. One non-limiting example of such a further use is as the centerpiece for the bride and groom table at a wedding reception. To this end, a removable display retainer according to the disclosure may be further adapted for a subsequent use. For example, in the case of a removable display retainer that will also serve as the centerpiece for the bride and groom table at a wedding reception, the removable display retainer may include folding legs or other support elements, or may be adapted for easy attachment of such support elements. It may also be possible to provide a removable display retainer having separable sections such that, after removal from an associated decorative structure, the decorated removable display retainer may be separated into several segments, each of which may function as a further decoration at a subsequent location. The sections of such a removable display retainer embodiment may be releasably connected using any appropriate connection means known in the art.

In some embodiments, a removable display retainer of one decorative structure may be interchangeable with a removable display retainer of another decorative structure. This will largely depend, of course, on the configurations and sizes of the particular decorative structures of interest. In this regard, it may also be possible to design and build a series of decorative structures that are dissimilar in configuration (e.g., a rectangular pergola and an octagonal gazebo) but nonetheless all utilize a removable display retainer of common configuration and size.

It should also be realized that while the present disclosure describes a case where a decorated removable display retainer is removed from an associated decorative structure and transported to another location for further use, the opposite situation is also possible. That is, a removable display retainer of a given decorative structure may be decorated and initially used at a location other than the decorative structure, and then transported to the decorative structure and removably attached thereto for further use.

While certain exemplary embodiments are described in detail above, the scope of the disclosure is not considered limited to such embodiments, and modifications are possible without departing from the spirit of the disclosure as evidenced by the following claims:

What is claimed is:

1. An upright decorative structure having a removable, dual-function decorative display, comprising:

a framework assembled to form a structure selected from the group consisting of an arch, an arbor, a pergola, a gazebo, and a pillar;

a removable display retainer retention assembly associated with at least one side of the framework; and a removable display retainer adapted for adornment with a plurality of three dimensional decorative items while detached from the framework of the decorative structure and for reattachment with the framework of the decorative structure after adornment, the removable display retainer having a framework-facing face, and an outward-facing face adorned with the plurality of three-dimensional decorative items, the removable display retainer, in a first function, removably engageable with the removable display retainer retention assembly so as to be supported by the framework with the plurality of three-dimensional decorative items being substantially visible along the at least one side of the framework;

wherein the adorned removable display retainer is further adapted, in a second function, for placement on top of a table with the framework-facing face of the removable display retainer facing the table and at least some of the plurality of three-dimensional decorative items extending away from the table.

2. The decorative structure of claim 1, wherein the plurality of three-dimensional decorative items are flowers.

3. The decorative structure of claim 1, wherein the removable display retainer has a similar composition to that of components of the framework.

4. The decorative structure of claim 1, wherein the removable display retainer has a dissimilar composition to that of components of the framework.

5. The decorative structure of claim 1, wherein more than one removable display retainer is present.

6. The decorative structure of claim 1, wherein the removable display retainer retention assembly includes at least a pair of spaced apart mounting blocks, with a retention pin extending from each mounting block.

7. The decorative structure of claim 1, wherein the removable display retainer includes a removable display retainer retention assembly engagement feature that is adapted to releasably engage with a corresponding engagement feature of the removable display retainer retention assembly.

8. The decorative structure of claim 7, wherein the removable display retainer retention assembly engagement feature and the removable display retainer engagement feature are selected from the group of engageable components consisting of a hook and eye screw/bolt assembly; sawtooth hangers, wire, or D-rings in combination with appropriate male components comprising threaded fasteners, nails or hooks; pins and grommets; an interlocking wedge or cleat assembly; and a hook and loop fastener assembly, with either component of a pair of engageable components of said group useable as a removable display retainer retention assembly engagement feature or a removable display retainer engagement feature.

9. The decorative structure of claim 7, wherein the removable display retainer retention assembly engagement feature is a pin and the removable display retainer engagement feature is a corresponding keyhole slot.

10. The decorative structure of claim 9, wherein the pin is in the form of a bolt.

11. The decorative structure of claim 1, wherein the removable display retainer is a board.

12. A decorative structure having a removable and decoratable element, comprising:

a framework assembled to form a structure selected from the group consisting of an arch, an arbor, a pergola, a gazebo, and a pillar;

at least one removable display retainer retention assembly associated with one or more portions of the framework; and at least one removable display retainer acting as the decoratable element, the at least one removable display retainer in the form of a board or plank having a rear face and a front face, the at least one removable display retainer engageable with the at least one removable display retainer retention assembly such that the at least one removable display retainer will be supported by the framework with the front face of the at least one removable display retainer facing away from at least one side of the framework and substantially perpendicular to the ground;

wherein the at least one removable display retainer is further adapted to be disengaged from the at least one removable display retainer retention assembly, decorated remotely from the framework, and subsequently removably reengaged with the at least one removable display retainer retention assembly.

13. The decorative structure of claim 12, wherein the removable display retainer has a similar appearance to that of one or more components of the framework.

14. The decorative structure of claim 12, wherein the at least one removable display retainer includes an engagement feature in the form of a keyhole slot and the at least one removable display retainer retention assembly includes an engagement feature in the form of a corresponding pin.

15. The decorative structure of claim 12, wherein the removable display retainer retention assembly includes a removable display retainer engagement feature and the removable display retainer includes a removable display retainer retention assembly engagement feature, which are selected from the group of engageable components consisting of a hook and eye screw/bolt assembly; sawtooth hangers, wire, or D-rings in combination with appropriate male components comprising threaded fasteners, nails or hooks; pins and grommets; an interlocking wedge or cleat assembly; and a hook and loop fastener assembly, with either component of a pair of engageable components of said group useable as a removable display retainer retention assembly engagement feature or a removable display retainer engagement feature.

16. The decorative structure of claim 12, wherein the at least one removable display retainer retention assembly is located so as to hang the at least one removable display retainer from a beam or rafter of the framework.

17. The decorative structure of claim 14, wherein the pin is a bolt.

18. A decorative structure having a removable and decoratable element, comprising:

a framework having a plurality of substantially upright support members, and a plurality of connecting members connecting the support members to form a structure selected from the group consisting of an arch, an arbor, a pergola, a gazebo, and a pillar;

a removable display retainer retention assembly associated with the framework, the removable display retainer retention assembly including at least a pair of spaced apart mounting blocks extending outward from the framework, each mounting block including a removable display retainer engagement feature; and a removable display retainer in the form of a decoratable beam or plank, the removable display retainer having a removable display retainer retention assembly engagement feature corresponding to the engagement feature of each mounting block;

wherein, the removable display retainer is adapted for adornment with one or more decorative items while detached from the remainder of the decorative structure and for reattachment with the decorative structure after adornment.

19. The decorative structure of claim 18, wherein the removable display retainer has a similar appearance to that of one or more components of the framework.

20. The decorative structure of claim 18, wherein the removable display retainer retention assembly engagement features and the removable display retainer engagement features are selected from the group of engageable components consisting of a pin and keyhole slot; a hook and eye screw/bolt assembly; sawtooth hangers, wire, or D-rings in combination with appropriate male components comprising threaded fasteners, nails or hooks; pins and grommets; an interlocking wedge or cleat assembly; and a hook and loop fastener assembly, with either component of a pair of engageable components of said group useable as a removable display retainer retention assembly engagement feature or a removable display retainer engagement feature.

* * * * *